US011801588B2

(12) United States Patent
Wu et al.

(10) Patent No.: US 11,801,588 B2
(45) Date of Patent: Oct. 31, 2023

(54) PNEUMATIC HAND TOOL WITH ADJUSTABLE OPERATING ANGLE

(71) Applicant: DE POAN PNEUMATIC CORP., New Taipei (TW)

(72) Inventors: I-Tsung Wu, New Taipei (TW); Yi-Wei Wen, New Taipei (TW); Tong Wang, New Taipei (TW)

(73) Assignee: DE POAN PNEUMATIC CORP., New Taipei (TW)

( * ) Notice: Subject to any disclaimer, the term of this patent is extended or adjusted under 35 U.S.C. 154(b) by 38 days.

(21) Appl. No.: 17/673,494

(22) Filed: Feb. 16, 2022

(65) Prior Publication Data

US 2022/0274233 A1 Sep. 1, 2022

(30) Foreign Application Priority Data

Feb. 26, 2021 (TW) ..... 110107031

(51) Int. Cl.
*B25B 21/02* (2006.01)
*B25B 23/16* (2006.01)
*B25B 23/00* (2006.01)

(52) U.S. Cl.
CPC ..... *B25B 21/026* (2013.01); *B25B 23/00* (2013.01); *B25B 23/0028* (2013.01)

(58) Field of Classification Search
CPC ... B25B 21/00; B25B 21/026; B25B 23/0028; B25B 23/16; B25B 13/48; B25G 1/043; B25G 1/063; B23Q 5/045
USPC ..... 173/168, 169, 90
See application file for complete search history.

(56) References Cited

U.S. PATENT DOCUMENTS 2,496,027 A * 1/1950 Trapet ..... B25D 9/14 173/39
2,501,217 A * 3/1950 Hawn ..... F16C 1/04 408/127
2,542,038 A * 2/1951 Lewis ..... B25F 5/02 403/96
3,571,874 A * 3/1971 Von Arz ..... B25F 5/02 29/81.17
4,748,872 A * 6/1988 Brown ..... B25B 21/001 81/57.26
4,901,608 A * 2/1990 Shieh ..... B25G 1/063 81/177.8
5,020,281 A * 6/1991 Neff ..... B24B 41/04 451/344

(Continued)

*Primary Examiner* — Dariush Seif
(74) *Attorney, Agent, or Firm* — Chun-Ming Shih; HDLS IPR SERVICES

(57) ABSTRACT

The present invention provides a pneumatic hand tool with adjustable operating angle, comprising a grip body and a tool head body interconnected with each other. The grip body has a grip flow channel, and said tool head body has a tool head flow channel. The grip body and said tool head body are interconnected through two rotary joint faces to form a joint portion capable of adjustment of the operating angle. The two rotary joint faces respectively have connecting areas for uniform circumferential motion and high pressure air ports configured along the rotation center. And the two rotary joint faces are inclined to facilitate adjustment of the operating angle of said tool head, and to ensure good air tightness of the high pressure air ports inside the joint portion.

19 Claims, 6 Drawing Sheets

(56) References Cited

U.S. PATENT DOCUMENTS 5,372,420 A * 12/1994 Van Deursen ..... B25F 5/02 241/285.2
5,687,802 A * 11/1997 Spooner ..... B25F 5/02 173/169
5,727,296 A * 3/1998 Kobler ..... B23Q 1/54 409/165
5,784,934 A * 7/1998 Izumisawa ..... B25B 21/004 81/177.8
6,026,910 A * 2/2000 Masterson ..... B25F 5/006 267/141.1
6,039,126 A * 3/2000 Hsieh ..... B66F 3/12 173/217
6,122,808 A * 9/2000 Popp ..... B23Q 1/0036 29/48.5 R
6,139,359 A * 10/2000 Fuhreck ..... H01R 13/6277 439/500
6,311,583 B1 * 11/2001 Izumisawa ..... B25G 1/066 81/177.8
6,928,902 B1 * 8/2005 Eyssallenne ..... B25F 5/02 81/57.44
7,082,864 B1 * 8/2006 Weber ..... B25B 13/56 81/492
7,278,342 B1 * 10/2007 Chang ..... F16D 3/20 81/177.85
7,347,127 B2 * 3/2008 Hu ..... B25G 1/066 81/177.85
7,481,135 B2 * 1/2009 Schoenbeck ..... B25G 1/066 81/177.8
7,509,894 B2 * 3/2009 Chen ..... B25B 21/00 81/177.9
8,555,999 B2 * 10/2013 McRoberts ..... B25F 5/02 173/217
9,144,471 B2 * 9/2015 Carron ..... A61C 17/005
9,266,230 B2 * 2/2016 Maddilate ..... B25F 5/02
10,626,725 B2 * 4/2020 Wu ..... F16K 11/074
2001/0052275 A1 * 12/2001 Liao ..... B25G 1/066 81/177.7
2007/0084616 A1 * 4/2007 Lam ..... B25F 5/02 173/217
2007/0259723 A1 * 11/2007 Bertani ..... B25B 23/0028 464/134
2011/0058913 A1 * 3/2011 Brieden ..... B23Q 5/045 409/230
2011/0229255 A1 * 9/2011 Su ..... B25B 13/48 403/122
2014/0190715 A1 * 7/2014 Wong ..... B24B 23/04 173/39
2016/0325412 A1 * 11/2016 Chen ..... B25G 1/043
2018/0311801 A1 * 11/2018 Ikuta ..... B25B 23/0028
2018/0325574 A1 * 11/2018 Bjork ..... A61B 17/1631
2019/0003306 A1 * 1/2019 Wu ..... F01C 1/3442
2019/0009398 A1 * 1/2019 Zhong ..... B23B 45/02
2021/0205966 A1 * 7/2021 Ho ..... B25B 23/0028
2022/0274233 A1 * 9/2022 Wu ..... B25B 21/00
2023/0032515 A1 * 2/2023 Chen ..... B23Q 5/20

* cited by examiner

PNEUMATIC HAND TOOL WITH ADJUSTABLE OPERATING ANGLE

BACKGROUND OF INVENTION

1. Field of the Invention

The present invention relates generally to a pneumatic hand tool, and more particularly to a pneumatic hand tool with adjustable operating angle.

2. Description of Related Art

Pneumatic hand tools are handheld tools using high pressure air as power source. Generally, such tools can include pneumatic wrenches and pneumatic screw drivers featuring rotational motion power output, and pneumatic nail guns and pneumatic hammers featuring linear motion power output. All these pneumatic hand tools have a grip for the operator to hold in hand, and a tool head for motion power output.

In a conventional pneumatic hand tool, the grip and the tool head are fixed together to form an integral body (i.e., integral design), and the tool head has a fixed operating angle. However, the pneumatic hand tools are used in diversified environments. There may be obstacles that block the operating space, or narrow gaps or curved spaces where operation becomes very difficult or inconvenient because of the integral design of the grip and the tool head of the above-mentioned conventional pneumatic hand tool. Such difficulty or inconvenience caused by the limit of the environment will affect the progress of the engineering project.

In order to overcome this problem, Taiwanese Patent Publication No. 1711511 has provided a pneumatic wrench with adjustable operating angle of the tool head. The invention features a pivot structure (i.e., joint portion) formed by ears on the two sides of the tool head and the grip and a pivotal axis, so as to enable back and forth swinging, i.e., adjustment of the operating angle. With such a design, the operator can use one hand to hold the grip of the pneumatic hand tool, and use the other hand to rotate and adjust the operating angle of the tool head in relation to the grip. In addition, according to the above patent, inside the pivot structure (i.e., joint portion), a high pressure air flow channel is provided, so that, when the operator rotates and adjusts the tool head to an angle suitable for operation, the high pressure air flow channel inside the pivot structure (i.e., joint portion) can always guide the high pressure air inside the grip to flow into the tool head to drive the operation of the tool head. However, the pivot structure (i.e., joint portion) will put a limit on the adjustable operating angle of the tool head. To be more specific, with the grip as the rotation center, the tool head can be turned forward or backward for maximum 60 degrees, and therefore the maximum operating angle is 120 degrees. In addition, in order for the high pressure air to be guided from inside the grip to the tool head, the high pressure air flow channel must be configured on the two ears of the pivot structure (i.e., joint portion) and inside the pivotal axis. This makes the path of the high pressure air flow channel over-curved and complicated, and is not good for the life cycle of the pivot structure (i.e., joint portion) under the pressure of concentrated high pressure air inside it.

Further, there is a publication of a pneumatic wrench with adjustable operating angle of the tool head, featuring interconnection of the tool head and the grip through a universal joint (i.e., joint portion), so that the tool head can be rotated and adjusted to a required operating angle. In addition, according to this publication, the universal joint is configured with a soft tube to guide high pressure air inside the grip to the tool head at any operating angle to drive the operation of the tool head. However, the tool head in this design also can only be turned forward or backward for maximum 60 degrees, and the overall maximum operating angle is also 120 degrees. Moreover, with frequent concentration of high pressure air, and frequent bending along with the turning and adjustment of the operating angle of the tool head, the life cycle of the soft tube will inevitably be affected. Therefore, using a soft tube inside the universal joint (i.e., joint portion) to guide high pressure air is not good and cannot guarantee a long life cycle of the pneumatic hand tool.

SUMMARY OF THE INVENTION

The object of the present invention is to improve the conventional pneumatic hand tool by providing a joint portion structure to adjust the operating angle of the tool head. With such a design, the operating angle of the tool head can be adjusted through uniform circumferential motion, and configuration of the high pressure air flow channel inside the joint portion can be simplified. Moreover, the high pressure air flow channel inside the joint portion can have smooth flow, good air tightness and long life cycle.

To this end, one embodiment of the invention provides a pneumatic hand tool with adjustable operating angle, that comprises: a grip body, formed along a linear axial direction, with the two ends of the grip body respectively having a first rotary joint face and an air inlet to introduce high pressure air, the first rotary joint face formed with a first port, the grip body having a grip flow channel to guide high pressure air, the grip flow channel connected between the air inlet and first port on the first rotary joint face; a tool head body, with its two ends respectively having a second rotary joint face and a driving head to output motion power, the second rotary joint face formed with a second port, the tool head body provided with a pneumatic driver and a tool head flow channel to guide high pressure air, the tool head flow channel connected between the second port on the second rotary joint face and an air intake of the pneumatic driver; wherein, the first rotary joint face and the second rotary joint face have interconnecting areas arranged for uniform circumferential motion, the grip body and the tool head body are interconnected in a form enabling rotation in relation to each other through the first rotary joint face and the second rotary joint face, the first port and the second port are interconnected, and the first rotary joint face and the second rotary joint face are at an angle of inclination in relation to the linear axial direction.

In a second embodiment, the first port is located at the rotation center of the first rotary joint face, and the second port is located at the rotation center of the second rotary joint face.

In a further embodiment, the peripheries of the first rotary joint face and the second rotary joint face are formed by enclosure of uniform round contours.

In a further embodiment, the angle of inclination is 45 degrees.

In a further embodiment, the grip flow channel and the tool head flow channel are interconnected in a form that they are perpendicular to the first rotary joint face and the second rotary joint face.

In a further embodiment, an airtight component is provided between the first rotary joint face and the second rotary joint face, the airtight component is located outside the first port and the second port, an air chamber is formed between the first rotary joint face, the second rotary joint face and the airtight component, and the first port is interconnected with the second port via the air chamber.

In a further embodiment, the invention also includes a buckle, configured on the grip body adjacent to the first rotary joint face or the second rotary joint face, and the buckle can stop the rotation of first rotary joint face and the second rotary joint face in relation to each other.

In a further embodiment, the invention also includes a buckle, configured on the tool head body adjacent to the first rotary joint face or the second rotary joint face, and the buckle can stop the rotation of the first rotary joint face and the second rotary joint face in relation to each other.

In a further embodiment, the tool head body is formed through an extension along the linear axial direction, the pneumatic driver is axially connected to the driving head along a motion power output axial direction, and the motion power output axial direction and the linear axial direction are not co-axial.

The pneumatic hand tool with adjustable operating angle according to the present invention also has another embodiment, wherein the pneumatic hand tool with adjustable operating angle comprises: a grip body, formed along a linear axial direction. The two ends of the grip body respectively have a grip joint and an air inlet to introduce high pressure air. The grip joint is formed with a grip air transmission port. The grip body has a grip flow channel inside it to guide high pressure air. The grip flow channel is communicated between the air inlet and the grip air transmission port; a tool head body, with its two ends respectively having a tool head joint and a driving head to output motion power. The tool head joint is formed with a tool head air intake. The tool head body is further provided with a pneumatic driver and a tool head flow channel to guide high pressure air. The tool head flow channel is communicated between the tool head air intake and an air intake of the pneumatic driver; a rotary connection seat, formed by a first rotary seat and a second rotary seat interconnected with each other. Specifically, the two ends of the first rotary seat respectively have a first joint and a first rotary joint face. The first joint is provided with a first connector. The first rotary joint face is provided with a first port. The first rotary seat also has a first flow channel to guide high pressure air. The first flow channel is communicated between the first connector and the first port. The two ends of the second rotary seat respectively have a second joint and a second rotary joint face. The second joint is provided with a second connector. The second rotary joint face is provided with a second port. The second rotary seat has a second flow channel inside it to guide high pressure air. The second flow channel is communicated between the second connector and the second port. Specifically, the first rotary seat is connected to the grip joint of the grip body via the first joint, so that the grip flow channel is communicated with the first flow channel via the grip air transmission port and the first connector. The second rotary seat is connected to the tool head joint of the tool head body via the second joint, so that the tool head flow channel is communicated with the second flow channel via the tool head air intake and the second connector.

In a further embodiment, the first flow channel and the second flow channel are interconnected in a form that they are perpendicular to the first rotary joint face and the second rotary joint face.

In a further embodiment, the invention also includes a buckle, configured on the first rotary seat adjacent to the first rotary joint face or the second rotary joint face. The buckle can stop the rotation of the first rotary joint face and second rotary joint face in relation to each other.

In a further embodiment, the invention also includes a buckle, configured on the second rotary seat adjacent to the first rotary joint face or the second rotary joint face. The buckle can stop the rotation of the first rotary joint face and the second rotary joint face in relation to each other.

Based on the designs described above, the present invention has the following technical performances:

1. The joint portion that connects the grip body and the tool head body uses two rotary joint faces interconnected face to face. Because a large uniform circumferential space can be formed between the two rotary joint faces, the tool head can be adjusted to any required operating angle in the 360-degree rotational area around the rotation center of the rotary joint faces.

2. Interconnecting ports are configured in the rotation centers of the two rotary joint faces for the high pressure air to pass through. Sufficient space is maintained between the two rotary joint faces to configure the airtight component, so that the airtight component is fitted outside the two ports, so that, when the tool head is rotated and adjusted to any operating angle, the two ports can rotate along the concentric tracks while maintaining good air tightness.

3. The two rotary joint faces are interconnected in an inclined form at the aforesaid angle of inclination, so that the tool head body can be rotated and adjusted to the required operating angle in an inclined form. Thus, the operating angle of the tool head body can be adjusted within a 90-degree folding range in relation to the linear axial direction of the grip body.

The technical features and practical functions of all embodiments disclosed herein are presented in the following descriptions and drawings.

DETAILED DESCRIPTION OF THE INVENTION

Figure 1:
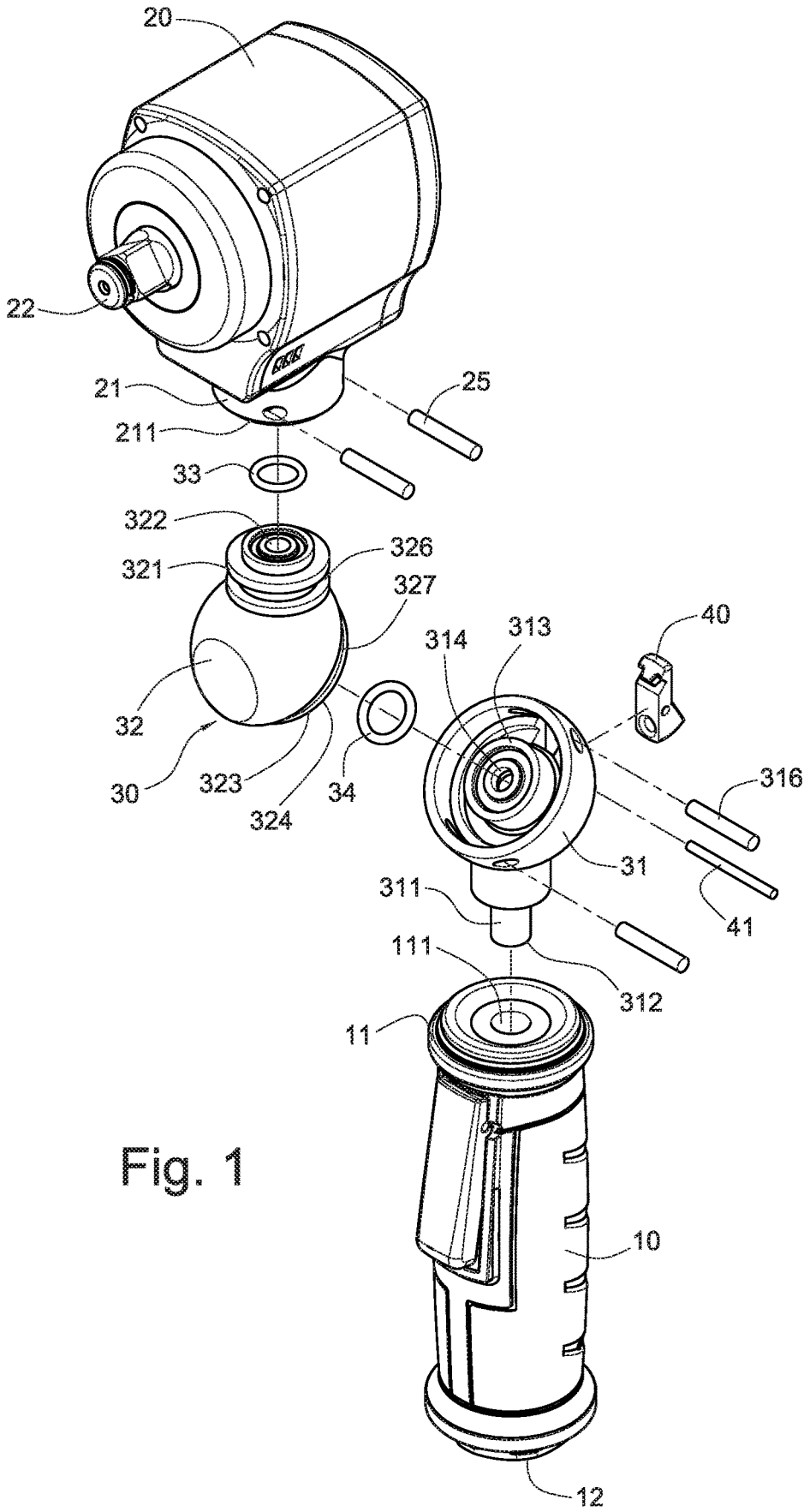
FIG. 1 is an exploded perspective view of the pneumatic hand tool with adjustable operating angle according to the present invention.
Figure 2:
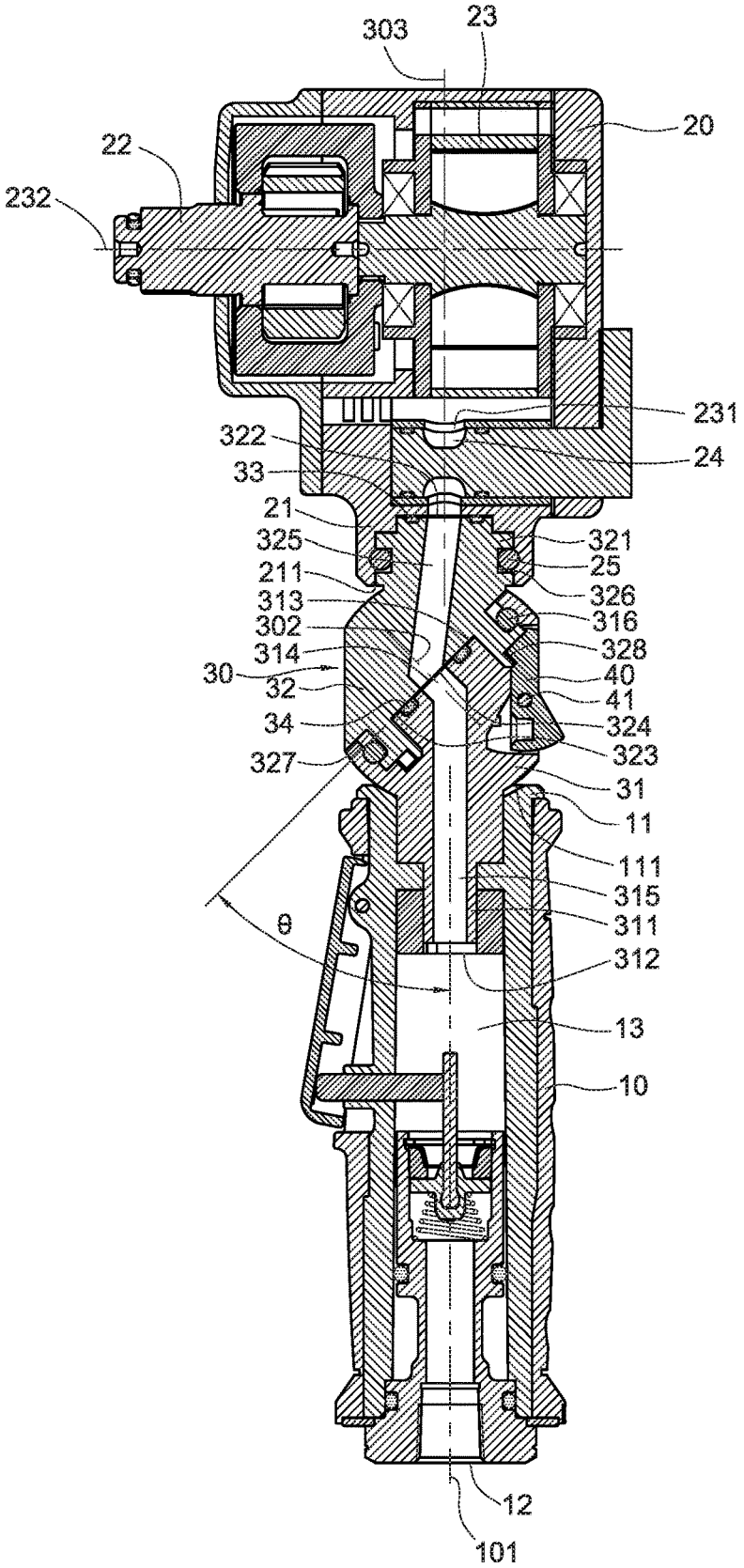
FIG. 2 is a sectional view of FIG. 1 after assembly.

Disclosed in FIG. 1 are configuration details of a preferred embodiment of the present invention. As depicted, the pneumatic hand tool with adjustable operating angle according to the invention comprises a grip body 10, a tool head body 20 and a rotary connection seat 30, having the following features:

Referring collectively to FIG. 1 and FIG. 2, the grip body 10 is formed along a linear axial direction 101, so that the grip body 10 is in a bar shape. The two ends of the grip body 10 are respectively provided with a grip joint 11 and an air inlet 12 for introduction of compressed high pressure air. The grip joint 11 is formed with a grip air transmission port 111. Inside the grip body 10, there is a grip flow channel 13 for the flow of the high pressure air. The air inlet 12 and the grip air transmission port 111 are connected to each other via the grip flow channel 13, so that the high pressure air can pass through the grip flow channel 13 and flow from the air inlet 12 toward the grip air transmission port 111.

The two ends of the tool head body 20 respectively have a tool head joint 21 and a driving head 22 to output motion power. The tool head joint 21 is formed with a tool head air intake 211. Inside, the tool head body 20 is provided with a pneumatic driver 23 and a tool head flow channel 24 for the high pressure air to pass through. The pneumatic driver 23 is axially connected to the driving head 22. The tool head air intake 211 and the air intake 231 of the pneumatic driver 23 are interconnected via the tool head flow channel 24, so that high pressure air can flow from the tool head air intake 211 toward the air intake 231 of the pneumatic driver 23 via the tool head flow channel 24. The high pressure air drives the pneumatic driver 23 to operate, and motion power is output by the driving head 22. Furthermore, the tool head body 20 is formed through an extension along a linear axial direction 101. The pneumatic driver 23 is axially connected to the driving head 22 via a motion power output axial direction 232. The motion power output axial direction 232 is not coaxial with the linear axial direction 101. In implementation, the axial direction of the tool head body 20 can be perpendicular to the axial direction of the pneumatic driver 23, but the present invention does not put a limit on this. In the present invention, the pneumatic driver 23 may differ based on the type of the pneumatic hand tool. For example: when the pneumatic hand tool is a pneumatic wrench or a pneumatic screw driver, the pneumatic driver 23 refers to the pneumatic motor; when the pneumatic hand tool is a pneumatic nail gun or pneumatic hammer, the pneumatic driver 23 refers to the cylinder.

Figure 3:
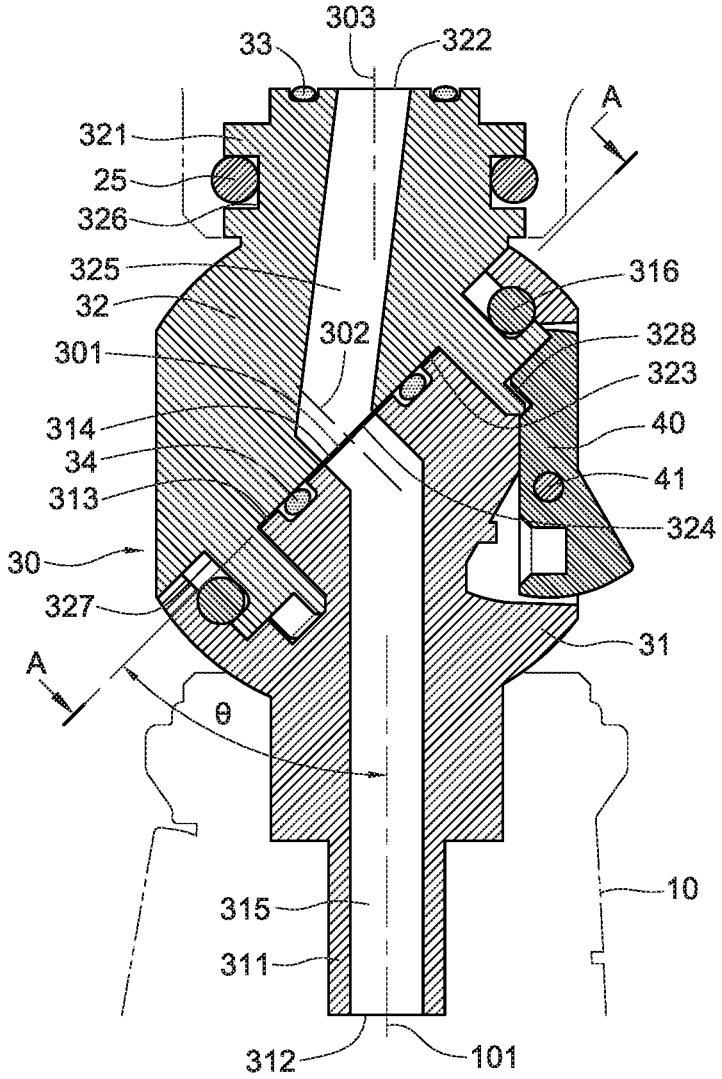
FIG. 3 is an enlarged sectional view of the rotary connection seat in FIG. 2.

Referring collectively to FIG. 1, FIG. 2 and FIG. 3, the rotary connection seat 30 is formed by interconnection of a first rotary seat 31 and a second rotary seat 32. The two ends of the first rotary seat 31 are respectively provided with a first joint 311 and a first rotary joint face 313. The first joint 311 is provided with a first connector 312. The first rotary joint face 313 is provided with a first port 314. Inside the first rotary seat 31, there is a first flow channel 315 for the high pressure air to pass through. The first connector 312 and the first port 314 are interconnected via the first flow channel 315. The two ends of the second rotary seat 32 are respectively provided with a second joint 321 and a second rotary joint face 323. The second joint 321 is provided with a second connector 322. The second rotary joint face 323 is provided with a second port 324. Inside the second rotary seat 32, there is a second flow channel 325 for the high pressure air to pass through. The second connector 322 and the second port 324 are interconnected via the second flow channel 325. Through coupling of the first rotary seat 31 and the second rotary seat 32, the first flow channel 315 and the second flow channel 325 are interconnected.

Further, the first rotary seat 31 is connected to the grip joint 11 of the grip body 10 via the first joint 311, so that the grip flow channel 13 is interconnected with the first flow channel 315 via the grip air transmission port 111 and the first connector 312. Thus, high pressure air can flow from the air inlet 12 of the grip body 10 toward the first port 314 of the first rotary joint face 313 on the first rotary seat 31 through the grip flow channel 13 and the first flow channel 315. The second rotary seat 32 is connected to the tool head joint 21 of the tool head body 20 via the second joint 321, so that the tool head flow channel 24 is connected to the second flow channel 325 via the tool head air intake 211 and the second connector 322. Thus, high pressure air can flow from the second port 324 on the second rotary joint face 323 of the second rotary seat 32 toward the air intake 231 of the pneumatic driver 23 through the second flow channel 325 and the tool head flow channel 24.

Figure 5:
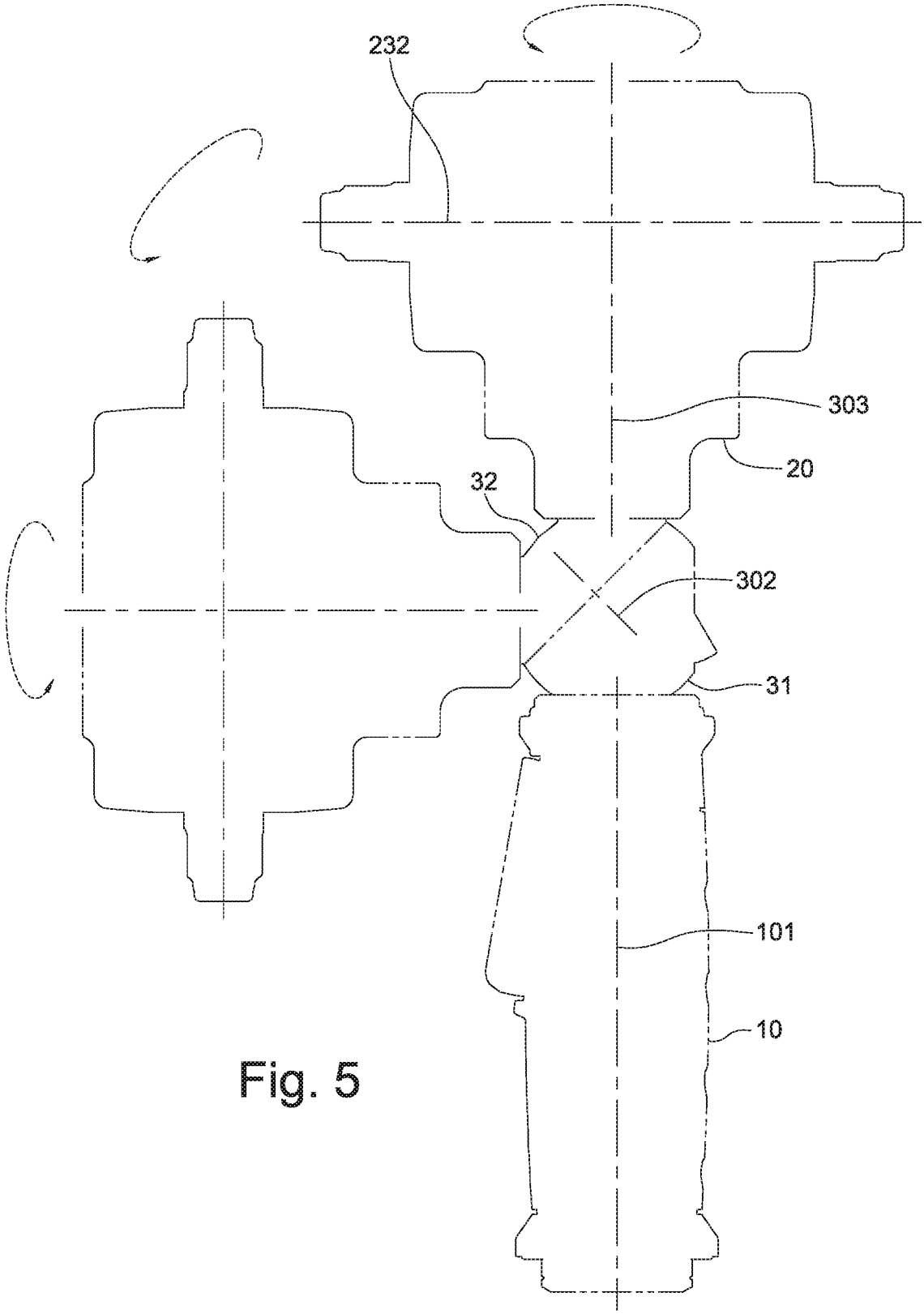
FIG. 5 is a schematic view of the tool head body in FIG. 2 adjusted to a different operating angle.

In an embodiment, the outside of the second joint 321 of the second rotary seat 32 is formed with a first ring groove 326. The two sides of the tool head joint 21 are respectively fitted with a positioning pin 25 that can fit into the first ring groove 326 along the tangent line of the groove. Through the first ring groove 326, the second rotary seat 32 is limited by the positioning pin 25 and coupled with the tool head joint 21 of the tool head body 20. Thus, the tool head body 20 is capable of 360-degree rotation around the second rotary center line 303 of the second rotary seat 32 (as shown in FIG. 5), so as to facilitate adjustment of the operating angle of the tool head body 20. Specifically, the second rotary center line 303 can be implemented to be co-linear with the linear axial direction 101 of the grip body 10, or to be parallel to but not co-linear with the linear axial direction 101. Moreover, between the tool head joint 21 of the tool head body 20 and the second rotary seat 32, an airtight component 33 is provided to guarantee air tightness between the tool head joint 21 of the tool head body 20 and the second rotary seat 32.

The outer end of the second rotary joint face 323 of the second rotary seat 32 is formed with a second ring groove 327. The two sides of the first rotary seat 31 are respectively fitted with a positioning pin 316 that can fit into the second ring groove 327 along the tangent line of the groove. Through the second ring groove 327, the second rotary seat 32 is limited by the positioning pin 316 and is coupled with the first rotary seat 31. Thus, the tool head body 20 is capable of 360-degree rotation around the first rotary center line 302 of the first rotary seat 31 (as shown in FIG. 5). Specifically, the first rotary center line 302 is the rotation center of the first rotary joint face 313 and the second rotary joint face 323, and an airtight component 34 is configured between the first rotary joint face 313 and the second rotary joint face 323 to guarantee air tightness when the first rotary joint face 313 and the second rotary joint face 323 are in relative rotation.

In implementation, because both the first rotary joint face 313 and the second rotary joint face 323 have joint areas of congruent circles for 360-degree rotation, they can be coupled face to face with a large relative area, and the operating angle of the tool head body 20 can be adjusted as needed within the 360-degree rotation area. Thus, through the first rotary seat 31 and the second rotary seat 32, the grip body 10 and tool head body 20 can be coupled in a rotary form, and the angle of the tool head body 20 can be adjusted in a rotary form around the grip body 10 (as shown in FIG. 5). Moreover, because the first port 314 on the first rotary joint face 313 and the second port 324 on the second rotary joint face 323 are interconnected, no matter what operating angle is the tool head body 20 adjusted to by rotation, the high pressure air can always flow smoothly from the grip body 10 into the tool head body 20 to drive the pneumatic driver 23 to output motion power. In implementation, the first rotary joint face 313 and the second rotary joint face 323 are positioned at an angle of inclination θ in relation to the linear axial direction 101. In one embodiment, the angle of inclination θ is 45 degrees, but the present invention does not put a limit on this. With such an implementation, the tool head body 20 is not only capable of 360-degree rotation independently around the second rotary center line 303 and the first rotary center line 302 for adjustment of the operating angle, but also capable of tilting at an angle of inclination θ ranging from 0-90 degrees in relation to the linear axial direction 101 of the grip body 10 for adjustment of the operating angle. Comparing to the conventional tool head on ordinary pneumatic hand tools that can only swing back and forth respectively for maximum 60 degrees, the tool head on the pneumatic hand tool according to the present invention is capable of very flexible adjustment of the operating angle.

Figure 4:
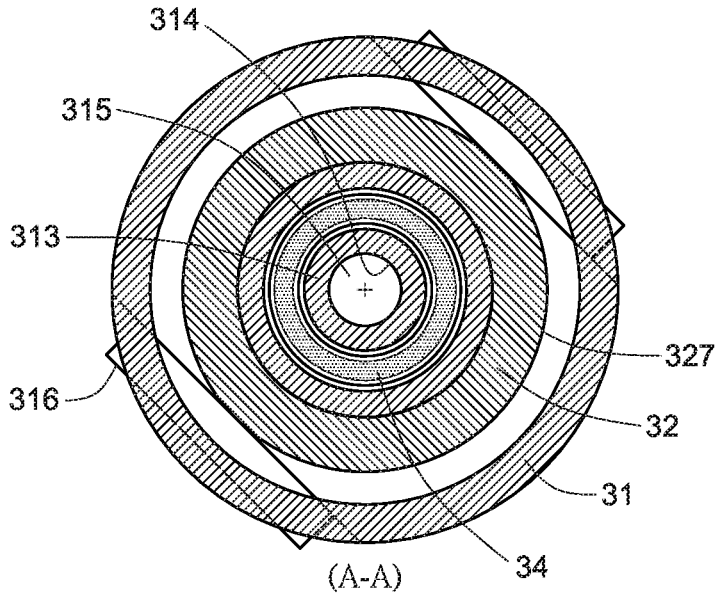
FIG. 4 is an A-A sectional view of FIG. 3.

Further, the first port 314 is located on the rotation center of the first rotary joint face 313, and the second port 324 is located on the rotation center of the second rotary joint face 323. Such configurations can guarantee that the first port 314 and second port 324 will not move off center at any rotation angle, and therefore can guarantee air tightness. The peripheries of the first rotary joint face 313 and the second rotary joint face 323 are formed by enclosure of uniform round contours (as shown in FIG. 4). Such a design can not only facilitate installations of the airtight component as well as the bearings and bushings for pivot connection, but also ensure a good sealing effect. In addition, the first flow channel 315 is formed along the axial direction of the first rotary seat 31, and the second flow channel 325 is formed along the axial direction of the second rotary seat 32. The first flow channel 315 and the second flow channel 325 respectively has a bent section adjacent to the first rotary joint face 313 and the second rotary joint face 323, so that the first flow channel 315 and the second flow channel 325 are interconnected in a form that they are perpendicular to the first rotary joint face 313 and the second rotary joint face 323. The first port 314 on the first rotary joint face 313 and the second port 324 on the second rotary joint face 323 are configured to be round, so that, when the tool head body 20 is rotated and adjusted to any operating angle, the first port 314 and the second port 324 can rotate in relation to each other along a concentric track while maintaining good air tightness.

In implementation, the airtight component 34 is located outside the first port 314 and the second port 324. An air chamber 301 is formed between the first rotary joint face 313, the second rotary joint face 323 and the airtight component 34. The first port 314 is interconnected with the second port 324 via the air chamber 301. Thus, even if the first port 314 and the second port 324 are not round or move off center, good air tightness can still be maintained.

It is to be noted that, in implementation, the first rotary joint face 313 can be formed on the grip body 10. The two ends of the grip flow channel 13 are respectively communicated with the air inlet 12 and the first port 314 on the first rotary joint face 313. The second rotary joint face 323 can be formed on the tool head body 20. The two ends of the tool head flow channel 24 are respectively communicated with the second port 324 on the second rotary joint face 323 and the air intake 231 of the pneumatic driver 23. In other words, when the first rotary joint face 31 is formed on the grip body 10 and the second rotary joint face 323 is formed on the tool head body 20, the grip body 10 and the tool head body 20 can be interconnected via the first rotary joint face 313 and the second rotary joint face 323, without the need of a rotary connection seat 30.

The present invention also includes a buckle 40. In implementation, the buckle 40 is configured on the grip body 10 or the first rotary seat 31 adjacent to the first rotary joint face 313 or the second rotary joint face 323. The tool head body 20 or the second rotary seat 32 are formed with a positioning slot 328 for the buckle 40 to lock, so that the buckle 40 can elastically lock the positioning slot 328 to stop the rotation of the first rotary joint face 313 and the second rotary joint face 323 in relation to each other, and thus restrict the angle after rotating the tool head body 20 in relation to the grip body 10. By pressing the buckle 40, it can be released from the positioning slot 328, so as to facilitate rotation of the first rotary joint face 313 and the second rotary joint face 323 in relation to each other, and adjustment of the tool head body 20 to a required operating angle. In addition, the buckle 40 can also be configured on the tool head body 20 or the second rotary seat 32 adjacent to the first rotary joint face 313 or second rotary joint face 323, and the positioning slot 328 can be formed on the grip body 10 or the first rotary seat 31. Such a design can also meet the need to stop the rotation of the first rotary joint face 313 and the second rotary joint face 323 in relation to each other.

Figure 6:
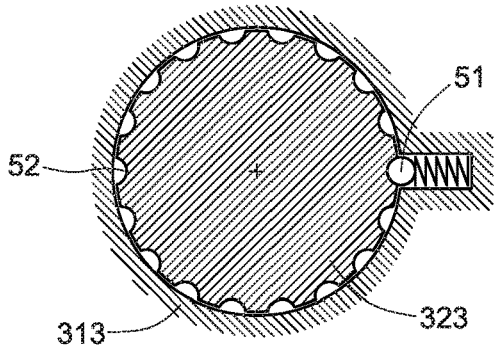
FIG. 6 to FIG. 8 are schematic views of different embodiments of the methods to stop the rotation between the first rotary joint face and the second rotary joint face.

Referring to FIG. 6, an elastic ball 51 and a ball catching groove 52 can be used to stop the rotation of the first rotary joint face 313 and the second rotary joint face 323 in relation to each other, and to restrict the angle after rotating the first rotary joint face 313 and the second rotary joint face 323, thus enabling adjustment of the tool head body 20 to a required operating angle.

Figure 7:
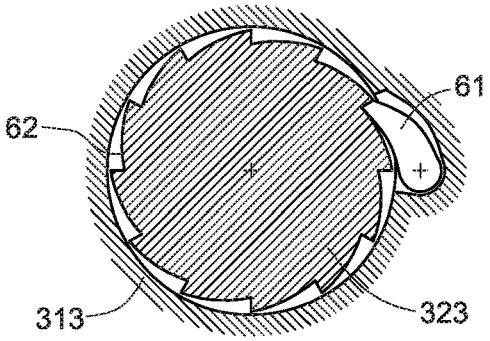

Referring to FIG. 7, a pawl 61 and a catching gear 62 can be used to stop the rotation of the first rotary joint face 313 and the second rotary joint face 323 in relation to each other, and to restrict the angle after rotating the first rotary joint face 313 and the second rotary joint face 323, thus enabling adjustment of the tool head body 20 to a required operating angle.

Figure 8:
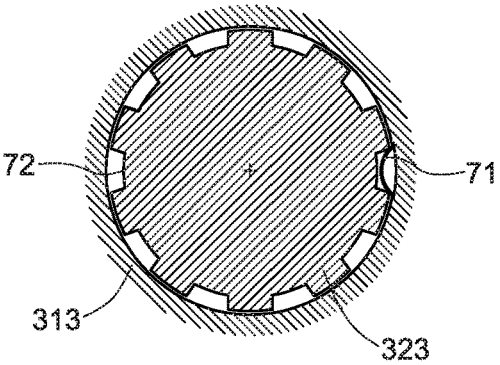

Referring to FIG. 8, an elastic contact plate 71 and a ring-shaped tooth groove 72 can be used to stop the rotation of the first rotary joint face 313 and the second rotary joint face 323 in relation to each other, and to restrict the angle after rotating the first rotary joint face 313 and the second rotary joint face 323, thus enabling adjustment of the tool head body 20 to a required operating angle.

Although the invention has been explained in relation to its preferred embodiment, it is to be understood that many other possible modifications and variations can be made without departing from the spirit and scope of the invention as hereinafter claimed.

The invention claimed is:

1. A pneumatic hand tool with adjustable operating angle, comprising:

a grip body, formed along a linear axial direction, the two ends of said grip body respectively have a first rotary joint face and an air inlet to introduce high pressure air, said first rotary joint face is formed with a first port, said grip body has a grip flow channel inside it to guide high pressure air, said grip flow channel is connected between said air inlet and said first port on said first rotary joint face;

a tool head body, with its two ends having a second rotary joint face and a driving head to output motion power, said second rotary joint face is formed with a second port, said tool head body is further provided with a pneumatic driver and a tool head flow channel to guide high pressure air, said tool head flow channel is connected between said second port on said second rotary joint face and an air intake of the pneumatic driver;

specifically, said first rotary joint face and said second rotary joint face have interconnecting areas arranged for uniform circumferential motion, said grip body and said tool head body are coupled together in an airtight manner via said first rotary joint face and said second rotary joint face, so that said first port and said second port are interconnected in an airtight manner, moreover, said first rotary joint face and said second rotary joint face are tilted at an angle of inclination in relation to the linear axial direction;

thereby, said tool head body is capable of 360-degree rotation around a first rotary center line that is a rotation center of said first rotary joint face and said second rotary joint face, and said tool head body is capable of 360-degree rotation around a second rotary center that is implemented to be co-linear with the linear axial direction, or to be parallel to but not co-linear with the linear axial direction.

2. The pneumatic hand tool with adjustable operating angle defined in claim 1, wherein said first port is located at the rotation center of said first rotary joint face, and said second port is located at the rotation center of said second rotary joint face.

3. The pneumatic hand tool with adjustable operating angle defined in claim 2, wherein the peripheries of said first rotary joint face and said second rotary joint face are formed by enclosure of uniform round contours.

4. The pneumatic hand tool with adjustable operating angle defined in claim 1, wherein said angle of inclination is 45 degrees.

5. The pneumatic hand tool with adjustable operating angle defined in claim 4, wherein said grip flow channel and said tool head flow channel are interconnected in a form that they are perpendicular to said first rotary joint face and said second rotary joint face.

6. The pneumatic hand tool with adjustable operating angle defined in claim 1, wherein an airtight component is provided between said first rotary joint face and said second rotary joint face, said airtight component is located outside said first port and said second port, an air chamber is formed between said first rotary joint face, said second rotary joint face, and said airtight component, said first port is interconnected with said second port via said air chamber.

7. The pneumatic hand tool with adjustable operating angle defined in claim 1, which further comprises a buckle, configured on an outer surface of said grip body adjacent to said first rotary joint face or said second rotary joint face, said buckle can stop the rotation of said first rotary joint face and said second rotary joint face in relation to each other.

8. The pneumatic hand tool with adjustable operating angle defined in claim 1, which further comprises a buckle, configured on an outer surface of said tool head body adjacent to said first rotary joint face or said second rotary joint face, said buckle can stop the rotation of said first rotary joint face and said second rotary joint face in relation to each other.

9. The pneumatic hand tool with adjustable operating angle defined in claim 1, wherein said tool head body is formed through an extension along the linear axial direction, the pneumatic driver is axially connected to the driving head along a motion power output axial direction, the motion power output axial direction is not coaxial with the linear axial direction.

10. A pneumatic hand tool with adjustable operating angle, comprising:

a grip body, formed along a linear axial direction, the two ends of said grip body respectively have a grip joint and an air inlet to introduce high pressure air, said grip joint is formed with a grip air transmission port, said grip body has a grip flow channel inside it to guide high pressure air, said grip flow channel is communicated between said air inlet and the grip air transmission port;

a tool head body, with its two ends respectively having a tool head joint and a driving head to output motion power, said tool head joint is formed with a tool head air intake, inside, said tool head body further has a pneumatic driver and a tool head flow channel to guide high pressure air, said tool head flow channel is communicated between said tool head air intake and an air intake of the pneumatic driver;

a rotary connection seat, form by interconnection of a first rotary seat and a second rotary seat, wherein:

the two ends of said first rotary seat respectively have a first joint and a first rotary joint face, said first joint is provided with a first connector, said first rotary joint face is provided with a first port, said first rotary seat further has a first flow channel inside it to guide high pressure air, said first flow channel is communicated between said first connector and said first port;

the two ends of said second rotary seat respectively have a second joint and a second rotary joint face, said second joint is provided with a second connector, said second rotary joint face is provided with a second port, said second rotary seat further has a second flow channel inside it to guide high pressure air, said second flow channel is communicated between the second connector and said second port;

specifically, said first rotary seat is connected to said grip joint of said grip body via the first joint, so that said grip flow channel is communicated with said first flow channel via the grip air transmission port and said first connector;

said second rotary seat is connected to said tool head joint of said tool head body via the second joint, so that said tool head flow channel is communicated with said second flow channel via said tool head air intake and said second connector;

said first rotary joint face and said second rotary joint face have interconnecting areas arranged for uniform circumferential motion, said grip body and said tool head body are interconnected via said first rotary joint face and said second rotary joint face in a rotary manner, so that said first port on said first rotary joint face and said second port on said second rotary joint face are interconnected, and communicated to said first flow channel and said second flow channel, said first rotary joint face and second rotary joint face are tilted at an angle of inclination θ in relation to the linear axial direction.

11. The pneumatic hand tool with adjustable operating angle defined in claim 10, wherein said first port is located at the rotation center of said first rotary joint face, and said second port is located at the rotation center of said second rotary joint face.

12. The pneumatic hand tool with adjustable operating angle defined in claim 11, wherein the peripheries of said first rotary joint face and said second rotary joint face are formed by enclosure of uniform round contours.

13. The pneumatic hand tool with adjustable operating angle defined in claim 10, wherein the angle of inclination is 45 degrees.

14. The pneumatic hand tool with adjustable operating angle defined in claim 13, wherein said first flow channel and said second flow channel are interconnected in a form that they are perpendicular to said first rotary joint face and said second rotary joint face.

15. The pneumatic hand tool with adjustable operating angle defined in claim 10, wherein an airtight component is provided between said first rotary joint face and said second rotary joint face, said airtight component is located outside said first port and said second port, an air chamber is formed between said first rotary joint face, said second rotary joint face, and said airtight component, said first port is interconnected with said second port via said air chamber.

16. The pneumatic hand tool with adjustable operating angle defined in claim 10, which further comprises a buckle, configured on an outer surface of said first rotary seat adjacent to said first rotary joint face or said second rotary joint face, said buckle can stop the rotation of said first rotary joint face and second rotary joint face in relation to each other.

17. The pneumatic hand tool with adjustable operating angle defined in claim 10, which further comprises a buckle, configured on an outer surface of said second rotary seat adjacent to said first rotary joint face or said second rotary joint face, said buckle can stop the rotation of said first rotary joint face and said second rotary joint face in relation to each other.

18. The pneumatic hand tool with adjustable operating angle defined in claim 10, wherein said tool head body is formed through an extension along the linear axial direction, said pneumatic driver is axially connected to the driving head along a motion power output axial direction, the motion power output axial direction is not coaxial with the linear axial direction.

19. The pneumatic hand tool with adjustable operating angle defined in claim 10, wherein said tool head body is capable of 360-degree rotation around a first rotary center line of said first rotary seat, and the first rotary center line is a rotation center of said first rotary joint face and said second rotary joint face; and said tool head body is capable of 360-degree rotation around a second rotary center line of said second rotary seat, and said second rotary center line is implemented to be co-linear with the linear axial direction, or to be parallel to but not co-linear with the linear axial direction.

* * * * *